US006595261B2

(12) United States Patent
Fitterer

(10) Patent No.: US 6,595,261 B2
(45) Date of Patent: Jul. 22, 2003

(54) APPARATUS FOR THE REMOVAL OF FLOOR COVERINGS

(76) Inventor: Christian Fitterer, Kornblumenstrasse 23, 76287 Rheinstetten (DE)

( * ) Notice: Subject to any disclaimer, the term of this patent is extended or adjusted under 35 U.S.C. 154(b) by 0 days.

(21) Appl. No.: 10/033,276

(22) Filed: Dec. 22, 2001

(65) Prior Publication Data

US 2002/0108720 A1 Aug. 15, 2002

(30) Foreign Application Priority Data

Feb. 14, 2001 (DE) ..... 101 06 730

(51) Int. Cl.[7] ..... B32B 35/00

(52) U.S. Cl. ..... 156/584; 156/344; 254/200; 254/203

(58) Field of Search ..... 156/344, 584; 254/199, 200, 202, 203, 208, 209, 210, 211, 213, 219, 227, 242, 262; 294/8.6, 103.1, 104, 119.1, 902; 269/53, 54.5; 16/5

(56) References Cited

U.S. PATENT DOCUMENTS 2,655,976 A * 10/1953 Lovin ..... 156/584
4,009,908 A * 3/1977 Alinder et al. ..... 299/37.1
4,330,938 A * 5/1982 Martin ..... 30/169
4,683,657 A * 8/1987 Anderson et al. ..... 30/170
4,948,451 A * 8/1990 Foltz ..... 156/344
4,963,224 A * 10/1990 Anderson ..... 156/584
5,002,629 A * 3/1991 Nakamura ..... 156/584
5,415,725 A * 5/1995 Scharf ..... 156/584
5,720,844 A * 2/1998 Hanson ..... 156/344
5,830,313 A * 11/1998 Smith ..... 156/584
6,113,075 A * 9/2000 McMichael et al. ..... 254/203

* cited by examiner

*Primary Examiner*—Mark A. Osele
(74) *Attorney, Agent, or Firm*—Klaus J. Bach

(57) ABSTRACT

In an apparatus for the removal floor coverings from a floor which apparatus comprises a support structure including a separating blade with a cutting edge arranged so as to be moved below the floor covering for separating the floor covering from the floor, a redirecting roller is rotatably supported on the support structure and the floor covering separated from the floor is moved past the redirecting roller and pressed into firm engagement therewith by a pressure roller mounted on the support structure adjacent the redirecting roller. Means or provided for driving the redirecting roller and the pressure roller thereby advancing the apparatus and moving the separating blade between the floor covering and the floor for separating the floor covering from the floor.

19 Claims, 3 Drawing Sheets

APPARATUS FOR THE REMOVAL OF FLOOR COVERINGS

BACKGROUND OF THE INVENTION

The invention relates to an apparatus for the removal of floor coverings such as PVC floor coverings or carpets, comprising a frame on which a separating blade is mounted and at least a first redirecting roller is rotatably supported for guiding the floor covering removed from the floor.

Such an apparatus is known for example from DE 2300668. The apparatus disclosed therein includes a plate which is so disposed as that it can be moved between the floor and the floor covering and which is oscillating back and forth. The plate includes a front edge in the form of a cutting edge. In order to eliminate the need to lift off, by hand, the floor covering strips, which have already been removed, this apparatus includes a roller with spikes extending radially from the roller. The spiked roller is disposed above the front edge of the back and forth oscillating plate and with its axis extending parallel thereto. With regard to the front edge of the plate, the spiked roller is so oriented that the outer surface area thereof which moves upwardly that is away from the support surface is disposed tangentially to a line extending vertically from the front edge of the plate. The floor covering is lifted off at such a pull angle that the front edge of the plate is always free to oscillate.

DE 298 10 100 U1 describes an apparatus for the removal of flexible floor coverings which includes a movable support structure supporting a floor covering removal apparatus including a rotating drum. Adjacent the floor, the apparatus includes a cutting structure by which a strip is severed from the floor covering. The strip is then wound onto the drum, which serves as a storage drum. With the winding of the strip onto the drum, the floor covering is removed from the floor. At the same time, the whole apparatus is advanced thereby.

With the known apparatus, the floor coverings can be removed with relatively little use of human force but the result is far from optimal. Particularly with the last mentioned apparatus pieces of the floor covering remain often attached to the floor since the floor covering is pulled off the floor and not separated therefrom by cutting blades. With the first mentioned apparatus, there is no optimum advancement drive for the apparatus. It has been found that a clean removal of the floor covering from the floor can only be achieved with appropriate advancement of the apparatus.

DE 115 791 A1 discloses further an apparatus for the removal of floor coverings which includes a support structure with a cutting blade and at least a first redirecting roller. The apparatus includes a pressure roller by which the floor covering redirected by a first redirecting roller is pressed into firm engagement with the first redirecting roller. The first redirecting roller is disposed with its circumference on the floor covering and is so arranged in the support structure that the support structure is advanced when the floor covering is firmly engaged with the first redirecting roller and the first redirecting roller is rotated. The cutting edge of the separating plate is spaced from the outer surface of the first redirecting roller by a distance, which corresponds to the thickness of the floor covering.

Although this apparatus fulfills the object of removing floor coverings, it has a disadvantage in that it does not remove the floor coverings well in critical areas such as in corner areas and stepped areas.

It is the object of the present invention to provide an apparatus for the removal of floor coverings which removes the floor coverings completely, also in critical areas, from the floor essentially without the need for operator assistance.

SUMMARY OF THE INVENTION

In an apparatus for the removal of floor coverings from a floor which apparatus comprises a support structure including a separating blade with a cutting edge arranged so as to be moved below the floor covering for separating the floor covering from the floor, a redirecting roller is rotatably supported on the support structure and the floor covering separated from the floor is moved past the redirecting roller and pressed into firm engagement therewith by a pressure roller mounted on the support structure adjacent the redirecting roller. Means are provided for driving the redirecting roller and the pressure roller thereby advancing the apparatus and moving the separating blade between the floor covering and the floor for separating the floor covering from the floor.

Since means are provided for firmly engaging the floor covering with the redirecting roller in a slip-free manner, a force is generated upon rotation of the redirecting roller by which the whole apparatus is properly advanced. The apparatus pulls itself forward on the floor covering as it removes the floor covering from the floor.

The cutting blade is so arranged that the cutting edge thereof is directed away from the redirecting roller and arranged in front of the redirecting roller. The cutting edge is disposed between the floor and the floor covering. In this way, the floor covering is safely and completely removed from the floor by the advancement of the apparatus. Since the cutting blade is further disposed in front of the redirecting roller, the cutting blade can be moved fully to a wall whereby the floor covering can be removed from the floor all the way to the wall. This eliminates the need for time consuming and expensive manual finishing work.

The floor covering removed from the floor is guided onto the redirecting roller with which it is engaged in a slip-free manner so that, upon rotation of the redirecting roller, the apparatus is steadily advanced and the cutting blade is continuously moved between the floor and the floor covering for detaching the floor covering from the floor. The apparatus according to the invention therefore does not require an external moving force for its advancement.

It has been found to be particularly advantageous if the apparatus includes a downholder, which is supported above the cutting edge of the cutting blade at a distance therefrom which equals about 1.5 times the thickness of the floor covering. With the downholder, the floor covering is guided onto the re-directing roller at an advantageous angle and is removed from the floor at an angle suitable for permitting efficient and effective removal by the cutting blade. Preferably, the downholder it a roller which is rotatably supported for guiding the floor covering. In this way, friction forces are reduced to a minimum.

For slip-free engagement of the floor covering with the redirecting roller preferably a pressure roller is used. In this way, the floor covering can be pressed into firm engagement with the redirecting roller in a simple manner.

Generally, it is not necessary to provide the redirecting roller with a special surface for example by providing it with spikes, knubs or similar structures. If it is found however that the surface is not sufficiently slip-free for firmly engaging the floor covering, a non-skid coating may be applied to the redirecting roller surface. In that case, it is advantageous if such a coating is also applied to the pressure roller surface.

It has been found to be particularly advantageous to provide a second redirecting roller by which the floor covering guided and onto which it is pressed. It is preferable that the axes of the two redirecting rollers extend about parallel to each other and are disposed in the corners of an isosceles triangle.

With the second redirecting roller, the force transfer from the apparatus to the floor covering is increased in an advantageous manner. The apparatus can therefore be operated with a large advancing force. Furthermore, the advancement force is effective in a uniform manner.

In another embodiment of the invention, the pressure roller is supported so as to be adjustable with respect to its distance from the redirecting rollers. In this way, the force applied to the redirecting roller can be adjusted depending on the given requirements. It is particularly advantageous if the pressure roller is spring-biased toward the redirecting roller.

The arrangement may further include a drive belt which extends between the pressure roller and the redirecting rollers and which further extends over an auxiliary roller which is disposed above the pressure and the redirecting rollers. In this arrangement, the distance of the auxiliary roller from the other rollers is preferably adjustable. The width of the drive belt corresponds essentially to the width of the rollers.

With the drive belt extending around the rollers, all the rollers are driven at the same time. Only one of the rollers has to be provided with a drive means such as an electric motor. The drive force is transmitted by the drive belt to all the other rollers.

Furthermore, the drive belt is advantageously employed for guiding the floor covering through the apparatus. In addition, the friction and, consequently, the force transmission to the floor covering can be increased with the drive belt. For the transmission of large forces the drive belt is provided with a surface which has a high friction coefficient. With the auxiliary roller whose distance from the other rollers is adjustable, the tension of the drive belt can be adjusted.

It has been found to be particularly advantageous to provide two floor covering cutting blades which are arranged in spaced relationship that is at a distance from each other which corresponds about to the width of the rollers. The two cutting blades are adapted to cut the floor covering into strips, which are removed from the floor.

In still another embodiment of the invention, at least three pressure rollers are provided. The diameter of these pressure rollers is somewhat less than half the diameter of the redirecting roller so that they can be arranged at relatively short distances, one after another, around the redirecting roller. Instead of one pressure point by which the floor covering is engaged with the redirecting roller in a slip-free manner, there are three pressure points. In this way, the floor covering is more firmly engaged with the redirecting roller.

With the last-mentioned embodiment it is particular advantageous if additionally guide rollers are provided at the opposite ends of the arrangement of pressure rollers and a drive belt extends around the guide rollers and the pressure rollers. With the guide rollers, the floor covering is guided but they are so arranged that no forces in radial direction of the redirecting roller are effective by the floor covering. As a result, all the forces are directed toward the engagement of the floor covering with the redirecting roller, whereby the friction free engagement of the floor covering with the redirecting roller is further improved. In a further embodiment of the invention, the separating blades consist of individual elements which are supported so as to be independently pivotable about a first axis.

Since the separating blades are not in the form of a single rigid element, which can be raised or lowered only as a whole, but in the form of individual elements which may have a relatively small width, also areas of the floor adjacent raised sections with relatively small sideward dimensions can be worked. When reaching such a raised section only the respective separating blade element is raised which extends over the raised area. The individual elements of the separating blade away from the raised area remain in their position and work the floor area adjacent the raised area. In this way, the need for additional finishing work can be eliminated or at least substantially reduced.

Although the separating blade may comprise individual elements which are supported individually so as to be pivotable about separate axes it has been found to be advantageous if the individual blade elements are all pivotable about a common axis. It is particularly advantageous if the first axis extends in the plane, or parallel to the plane, of the separating blade. This is the case for example when none of the individual blade elements is subjected to a deflection that is the individual elements are disposed all in a single plane and the first axis extends parallel to the cutting edge of the separating blade.

In a particular embodiment of the invention, the individual blade elements are rotatable about a second axis, which extends at an angle of about 90° with respect to the first axis. This results in an improved efficiency of the apparatus according to the invention. With the individual blade elements being rotatable about the second axis, uneven floor areas can be handled by the separation blades which are not parallel to the floor but are inclined thereto as this is the case for example in connection with trapezoidal raised areas. Since elevations and depressions of the floor are generally not in the form of steps but have —like a trapezoid —inclined areas, floor coverings can be removed with such an embodiment of the invention particularly effectively.

In another embodiment of the invention, the individual blade elements are engaged by a first compression spring element for pivoting about the first axis. With the compression spring element, the individual blade elements adapt very fast and effectively to the unevenness of the floor. This is also true for another embodiment of the invention wherein the individual blade elements are engaged by a second spring element for pivoting about the second axis. With the second spring element, the individual blade elements are rapidly returned to their original positions when they are not subjected to an outer force resulting from the floor.

In a further advantageous embodiment of the invention, a locking element is provided by which the individual blade elements can be locked in a predetermined position. The locking element prevents pivoting of the individual elements about the first axis. However, it may also prevent the rotation of the individual elements about the second axis or both the pivoting of the individual blade elements about the first axis and their rotation about the second axis. With the locking element, a single cutting blade may be made available as it is the state of the art. But the locking element may also be so designed that a certain desirable form of the cutting edge of the separating blade can be established.

Further details, features and advantages of the invention will become apparent from the following description of a particular embodiment of the invention on the basis of the accompanying drawings.

DESCRIPTION OF A PREFERRED EMBODIMENT

Figure 1:
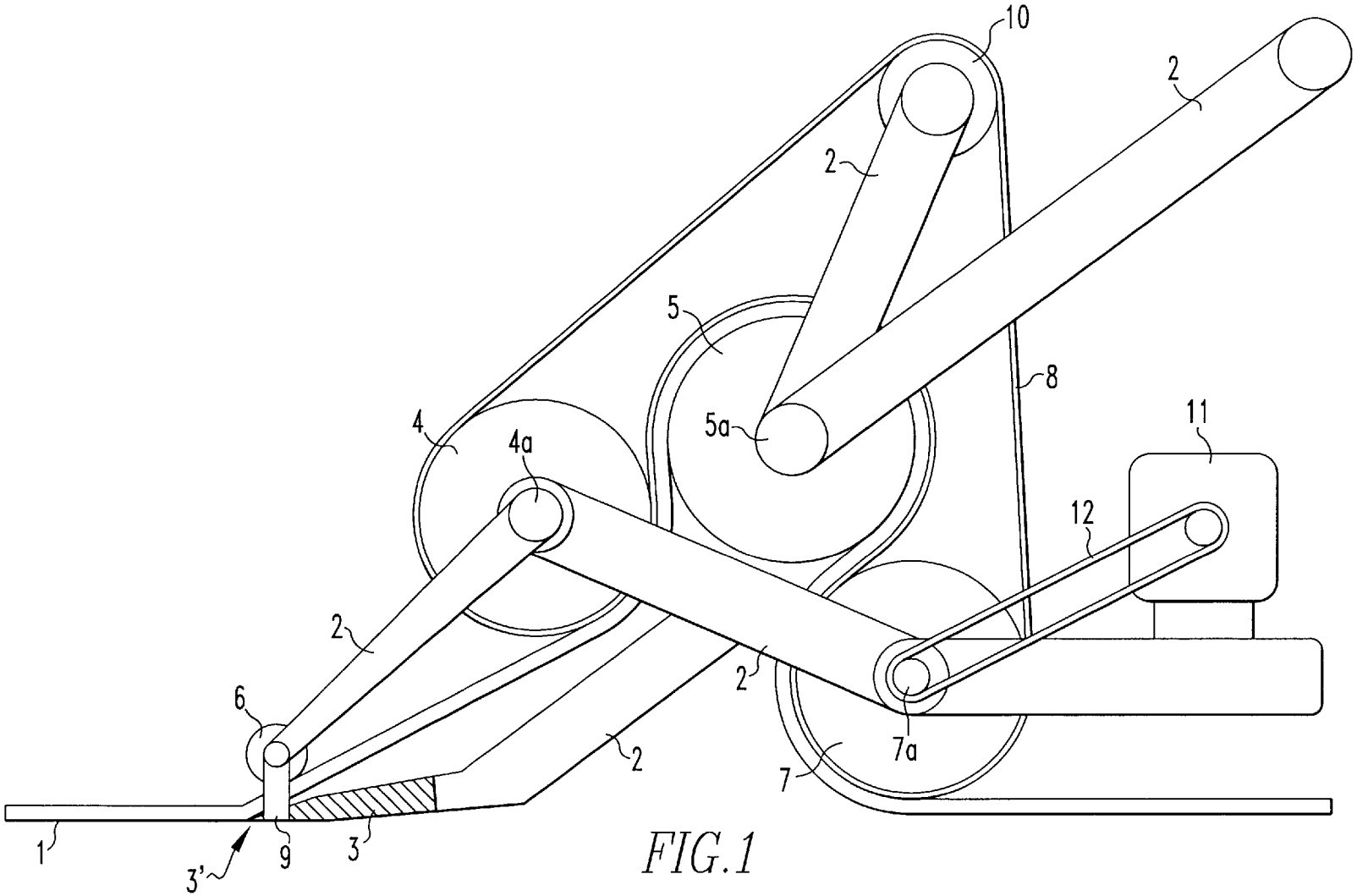
FIG. 1 is a schematic representation of the apparatus according to the invention in a side view.

As shown in FIG. 1, the apparatus according to the invention includes a support structure 2 in the form of a frame. A first redirecting roller 4 is supported on the support structure 4 so as to be rotatable about a first axis 4*a*. Further, a second redirecting roller 7 is supported by the support structure and is rotatable about a second axis 7*a*. The second redirecting roller 7 serves at the same time as a wheel on which the apparatus is supported on the floor so that the apparatus is movable. Above the two redirecting rollers 4, 7 a pressure roller 5 is supported about in the middle between the two redirecting rollers 4, 7, which pressure roller 5 is rotatable about a third axis 5*a*. The pressure roller 5 is so arranged that its height is adjustable whereby its distance from the two redirecting rollers 4, 7 can be adjusted. Above the pressure roller 5, an auxiliary roller 10 is arranged. It is so supported that its distance from the pressure roller 5 is adjustable. The axis 4*a* of the first redirecting roller 4, the axis 7*a* of the second redirecting roller 7 and the axis 5*a* of the pressure roller 5 extend parallel to each other and are arranged in the corner of an isosceles triangle.

A drive belt 8 extends through the arrangement consisting of the two redirecting rollers 4, 7 and the pressure roller 5 as well as the auxiliary roller 10 in such a way that it passes between the first redirecting roller 4 and the pressure roller 5 and between the second redirecting roller 7 and the pressure roller 5 and almost completely envelops the rollers. It further passes over the auxiliary roller 10. The width of the drive belt 8 corresponds about to the width of the rollers 4, 7, 5, 10.

The support structure 2 further carries a separating blade 3 which has a cutting edge 3 projecting forwardly from the first redirecting roller 4. Above the cutting edge 3', there is downholder in the form of a rotatable roller 6. The distance of the outer surface of the downholder roller 6 from the separating blade is about one and a half times the thickness of the floor covering 1. This distance is adjustable. The separation blade 3 is supported by the support structure so as to be adjustable in vertical and in horizontal direction. The separating blade 3 is furthermore spring loaded so that its cutting edge 3' is disposed on the floor with a predetermined engagement force.

At its front end, the apparatus further includes two vertical cutting blades 9 which are disposed at a distance from each other corresponding about to the width of the rollers 4, 5, 7. The cutting blades 9 are provided to cut the floor covering into strips of a width corresponding to that of the rollers.

A drive motor 11 is also mounted onto the support structure 2 and is coupled with the redirecting roller 7 by a drive belt 12, which transmits the torque of the motor 11 to the second redirecting roller 7.

For the removal of the floor covering 1, the cutting edge 3' of the separating blade 3 is disposed between the floor covering 1 and the floor. The floor covering 1 is first removed from the floor by manual advancement and is moved into the area between the first redirecting roller 4 and the pressure roller 5. When the floor covering 1 is engaged by the two rollers or, respectively, by the pressure roller 5 and the drive belt 8, it is pulled into the gap between the first redirecting roller 4 and the pressure roller 5. With the drive belt 8, the floor covering 1 is then guided around the pressure roller 5 and subsequently halfway around the second redirecting roller 7. The floor covering 1 is so redirected that it moves around the first redirecting roller 4 and reaches the area between the first redirecting roller 4 and the pressure roller 5. The pressure roller is so adjusted that it forces the floor covering into engagement with the first redirecting roller 4 with a predetermined force. In this way, a pulling force is exerted on the floor covering whereby the apparatus is advanced.

By the drive belt 8, the floor covering 1 is engaged with the pressure roller 5. After the floor covering is redirected around the pressure roller 5, it reaches the second redirecting roller 7 and is redirected also by this roller. With the redirection of the floor covering 1 around the first redirecting roller 4, the pressure roller 5 and the second redirecting roller 7, a large pulling force can be generated.

Figure 2:
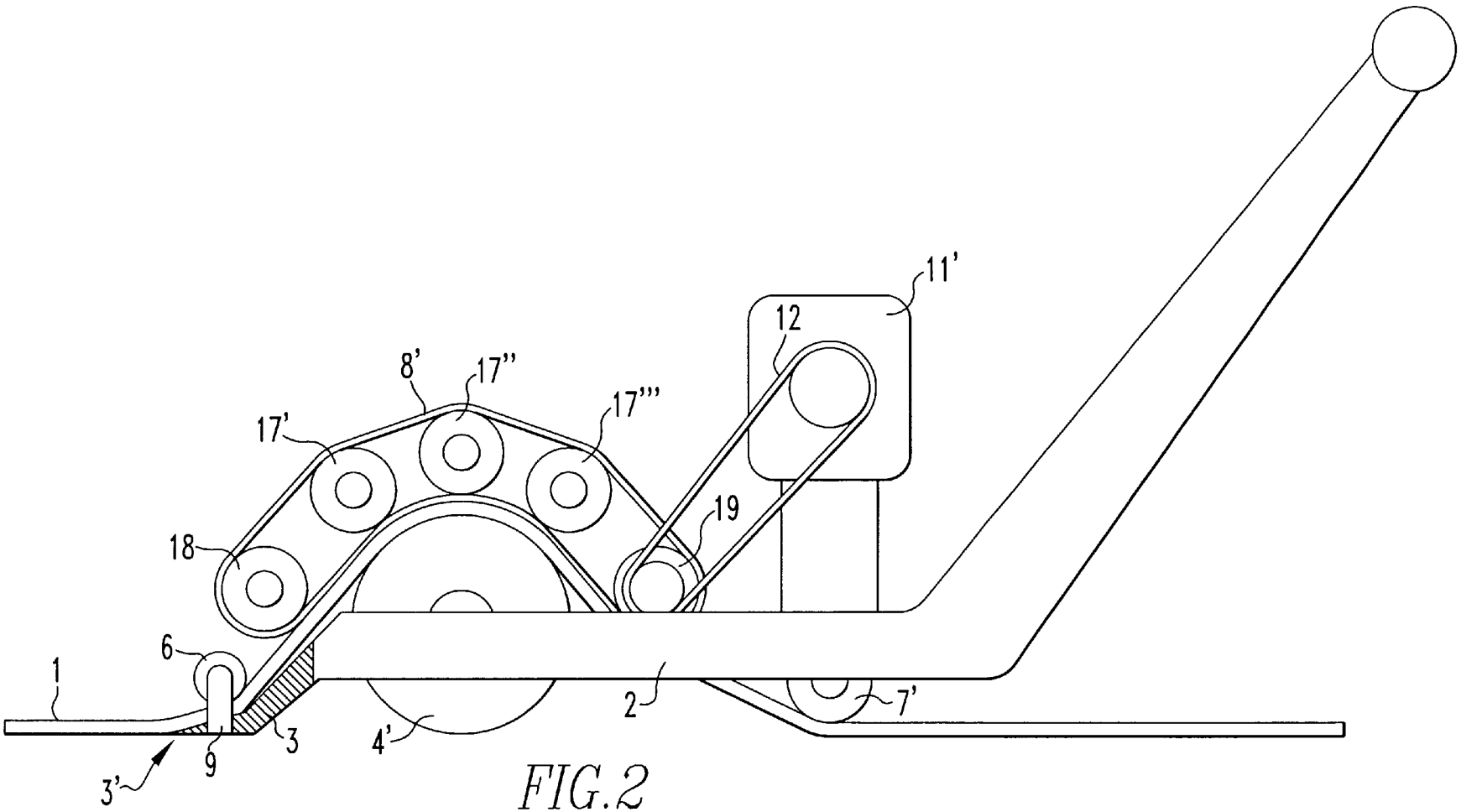
FIG. 2 shows schematically another embodiment of the invention, also in a side view.

The embodiment as shown in FIG. 2 corresponds essentially to that of FIG. 1. The same elements are therefore designated by the same reference numerals.

Instead of a single pressure roller, the arrangement as shown in FIG. 2 includes three pressure rollers 17', 17", 17"'. The diameter of the three pressure rollers 17', 17", 17"' is somewhat less than half the diameter of the redirecting roller 4'. Ahead of, and after the three pressure rollers 17', 17", 17"', there are guide rollers 18, 19. The arrangement including the guide rollers 18, 19 and the pressure rollers 17', 17", 17"', is enveloped by a drive belt 8. The pressure rollers 17', 17", 17"' are so arranged that their circumferential surfaces are disposed at a small distance from the circumferential surface of the first redirecting roller 4'. The distance is so large that a floor covering 1 disposed between the pressure roller 17', 17", 17"' and the first redirecting roller 4' is pressed onto the first redirecting roller 4' with a predetermined force. The rear guide roller 19 is driven by a motor 11'by way of a drive belt 12'. The pressure rollers 17', 17", 17"' and the front guide roller 18 are all driven by the guide belt 8', which extends around the guide roller 19, the pressure rollers 17', 17", 17"' and the guide roller 18.

The apparatus is supported on the floor by way of the first redirecting roller 4' and a small second redirecting roller 7'.

Figure 3:
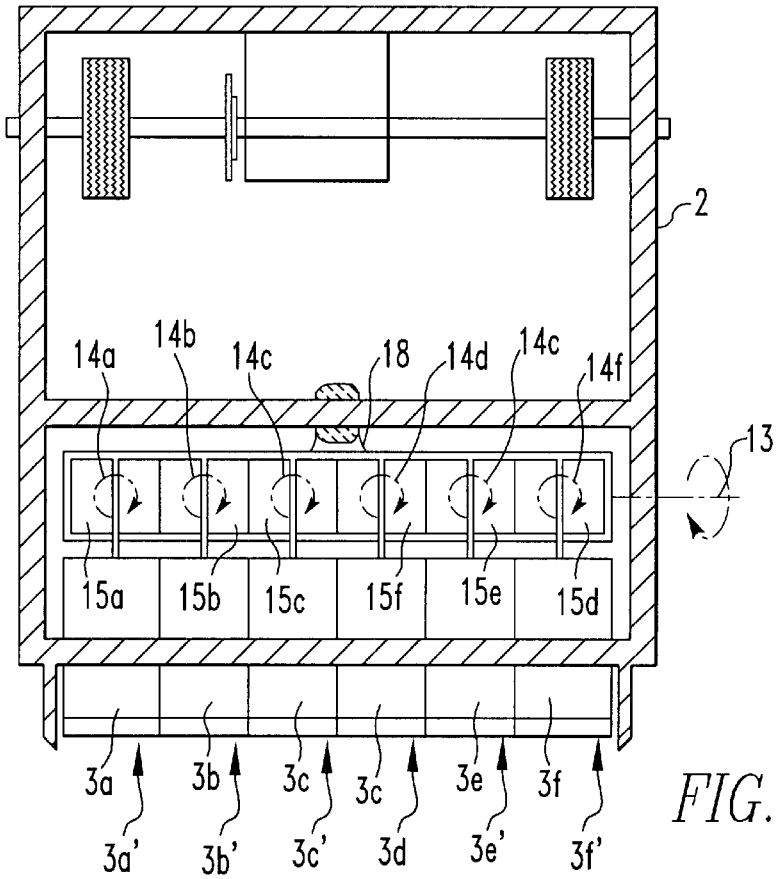
FIG. 3 shows the cutting blade arrangement consisting of individual cutting blades in a schematic top view.
Figure 4:
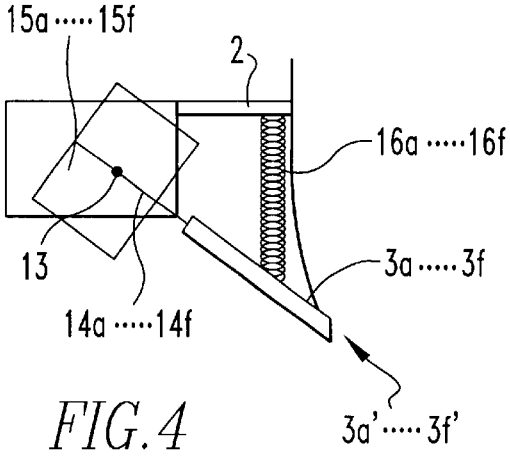
FIG. 4 is a schematic side view of an individual cutting blade.

As shown in FIGS. 3 and 4, the separating blade may consist of six individual elements 3*a* to 3*f*. The individual elements 3*a* to 3*f* are pivotally supported by separate pivot members 15*a* to 15*f*. The pivot members 15*a* to 15*f* are supported by the support structure 2 so as to be pivotable about an axis 13. The individual elements 3*a* to 3*f* are also pivotable about the axes 14*a*–14*f*, whereby the cutting edges 3*a'* to 3*f'* are also pivotable about the axes 14*a*–14*f*. As a result, the cutting edges 3*a'* to 3*f'* are adaptable to the level of the floor.

As shown particularly in FIG. 4, the individual blade elements 3*a* to 3*f* include spring elements 16*a* to 16*f* which are supported on the support structure 2 of the apparatus. The spring elements 16*a* to 16*f* engage the individual blade elements 3*a* to 3*f* such that the cutting edges 3*a'* to 3*f'* are biased onto the floor with a predetermined force.

The axes 14*a*–14*f* may be formed by torsion shafts providing spring structures resiliently holding the individual cutting elements 3*a*–3*f* in a position parallel to the floor but permitting their tilting about the axes 14*a*–14*f* for adaptation to any unevenness of the floor. Locking means 18 may be provided for locking the blades in parallel position with the floor.

What is claimed is:

1. An apparatus for the removal of floor coverings such as PVC coverings or carpets from a floor, comprising: a support structure, a separating blade with a cutting edge mounted to said support structure so as to project therefrom for movement under said floor covering for separating said floor covering from said floor, a redirecting roller rotatably supported on said support structure and arranged so as to abut the floor covering separated from said floor, means for firmly engaging said floor covering with said redirecting roller and means for driving said redirecting roller for advancing said apparatus to move said separating blade under said floor covering and separating said floor covering from said floor.

2. An apparatus according to claim 1, wherein a downholder is disposed on said support structure above the cutting edge of said separating blade so as to be spaced therefrom by a distance which is about one and a half times the thickness of the floor covering.

3. An apparatus according to claim 2, wherein said downholder is a roller rotatably supported on said support structure.

4. An apparatus according to claim 1, wherein said means for firmly engaging said floor covering with said redirecting roller is a pressure roller supported by said support structure so as to be biased toward said redirecting roller.

5. An apparatus according to claim 4, wherein a second redirecting roller is supported on said support structure and said floor covering extends also over said second redirecting roller and said pressure roller is so arranged that it is also biased toward said second redirecting roller for holding said floor covering also in firm engagement with said second redirecting roller.

6. An apparatus according to claim 5, wherein the axis of said first redirecting roller, the axis of said second redirecting roller and the axis of said pressure roller are all parallel to each other and disposed in the corners of an isosceles triangle.

7. An apparatus according to claim 4, wherein the distance of said pressure roller from said redirecting rollers is adjustable.

8. An apparatus according to claim 4, wherein a guide belt extends around said pressure roller and between the pressure roller and the redirecting rollers and around an auxiliary roller disposed above said pressure roller.

9. An apparatus according to claim 8, wherein said auxiliary roller is so supported that its distance from the pressure roller is adjustable.

10. An apparatus according to claim 1, wherein at least three pressure rollers are disposed closely adjacent one another around said redirecting roller for biasing said floor covering into firm engagement with said redirecting roller.

11. An apparatus according to claim 10, wherein guide rollers are disposed at opposite ends of the arrangement of pressure rollers and a guide belt extends around the guide and pressure rollers for firmly engaging said floor covering between said guide belt and said redirecting roller.

12. An apparatus according to claim 1, wherein two cutting blades are vertically mounted on said support structure in spaced relationship at a distance from each other which corresponds about to the width of said rollers for cutting said floor covering into strips upon removal from said floor.

13. An apparatus according to claim 1, wherein said separating blade includes a number of individual blade elements which are supported so as to be individually pivotable about a first axis.

14. An apparatus according to claim 13, wherein said individual blade elements are pivotable about a common axis.

15. An apparatus according to claim 13, wherein said first axis extends in, or parallel to, a plane in which said cutting blades are disposed.

16. An apparatus according to claim 13, wherein said individual blade elements are each pivotable about a second axis which extends normal to said first axis.

17. An apparatus according to claim 13, wherein each individual blade element is spring biased for pivoting about said first axis downwardly into engagement with said floor.

18. An apparatus according to claim 13, wherein said individual blade elements are each engaged by a second spring structure for pivoting about said second axis.

19. An apparatus according to claim 13, wherein a locking element is provided for locking said individual blade elements in a predetermined position.

* * * * *